US010020570B2

(12) United States Patent
Park et al.

(10) Patent No.: US 10,020,570 B2
(45) Date of Patent: Jul. 10, 2018

(54) ANTENNA DEVICE AND ELECTRONIC APPLIANCE HAVING THE SAME

(71) Applicant: SAMSUNG ELECTRONICS CO., LTD., Suwon-si (KR)

(72) Inventors: Jung-min Park, Seoul (KR); Byung-chul Kim, Hwaseong-si (KR); Hyun-jin Kim, Seoul (KR); Young-ju Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 565 days.

(21) Appl. No.: 13/929,385

(22) Filed: Jun. 27, 2013

(65) Prior Publication Data

US 2014/0125529 A1 May 8, 2014

(30) Foreign Application Priority Data

Nov. 8, 2012 (KR) ..... 10-2012-0126130

(51) Int. Cl.
*H01Q 1/42* (2006.01)
*H01Q 1/24* (2006.01)

(52) U.S. Cl.
CPC ..... *H01Q 1/42* (2013.01); *H01Q 1/243* (2013.01)

(58) Field of Classification Search
CPC ..... H01Q 1/243; H01Q 1/42
USPC ..... 343/702
See application file for complete search history.

(56) References Cited

U.S. PATENT DOCUMENTS

| | | | | |
|---|---|---|---|---|
| 7,760,147 | B2 * | 7/2010 | Nam | H01Q 9/0407 343/700 MS |
| 2008/0165065 | A1 * | 7/2008 | Hill | H01Q 1/243 343/702 |
| 2010/0103612 | A1 * | 4/2010 | Weber | H05K 5/0247 361/679.56 |
| 2011/0006953 | A1 * | 1/2011 | Chiang | G06F 1/1616 343/702 |

* cited by examiner

*Primary Examiner* — Dameon E Levi
*Assistant Examiner* — Walter Davis
(74) *Attorney, Agent, or Firm* — Sughrue Mion, PLLC

(57) ABSTRACT

An antenna device which is built into an electronic appliance having a metal cover provided with a radio wave passer is provided. The electronic apparatus includes an antenna portion arranged adjacent to the radio wave passer so as to be capable of transmitting and receiving radio waves through the radio wave passer. A reflecting portion which reflects the radio waves radiated from the antenna portion is located on an opposite side of the antenna portion, so that the antenna portion is between the reflecting portion and the radio wave passer.

13 Claims, 5 Drawing Sheets

ANTENNA DEVICE AND ELECTRONIC APPLIANCE HAVING THE SAME

PRIORITY

This application claims priority under 35 U.S.C. § 119(a) to Korean Patent Application No. 10-2012-0126130, filed on Nov. 8, 2012, in the Korean Intellectual Property Office, the disclosure of which is incorporated herein by reference, in its entirety.

BACKGROUND

1. Field

The inventive concept relates to an antenna device and an electronic appliance having an antenna. More particularly, the disclosure relates to an antenna device built into an electronic appliance of which an external appearance is made of a metal material.

2. Description of the Related Art

Recently, in compliance with consumer demands for elegant designs, electronic appliances having covers, which form external appearances thereof and most of which are made of metal materials, have been wide spread. Such electronic appliances have antenna portions for wireless communications or the like, which are not provided on the outside of the appliances; but rather are built in the appliances in accordance with the consumers' demands for the elegant designs. In the case of an electronic appliance in the related art, of which a cover is not made of a metal material, metal elements are arranged to be maximally spaced apart from the antenna portion of the electronic appliance.

However, in the case of designing an antenna device using a method in the related, art in an electronic appliance having a cover most of which is made of a metal material as described above, a large amount of radio waves radiated from an antenna portion flow into the electronic appliance rather than be emitted to the outside of the electronic appliance during radio wave transmission/reception.

Accordingly, there exists a need for schemes which improve the radio wave radiation efficiency of an antenna portion built in an electronic appliance having a cover, where the antenna, which is made mostly of a metal material, forms an external appearance thereof.

SUMMARY

Exemplary embodiments of the disclosure have been made to address at least the above problems and/or disadvantages and to provide at least the advantages described below. Accordingly, an aspect of the exemplary embodiments provides an electronic appliance having an antenna, which can improve the radio wave radiation efficiency of the antenna portion built into the electronic appliance of which an external appearance is made of a metal material.

According to one aspect of the exemplary embodiments, an antenna device built into an electronic appliance having a metal cover provided with a radio wave passer, includes an antenna portion arranged adjacent to the radio wave passer so as to be capable of transmitting and receiving radio waves through the radio wave passer; and a reflecting portion which reflects the radio waves radiated from the antenna portion to an opposite side of the radio wave passer toward the radio wave passer.

The antenna portion may be arranged between the radio wave passer and the reflecting portion.

A width of the reflecting portion may be equal to or larger than a width of the radio wave passer.

The reflecting portion may be arranged in parallel to the radio wave passer.

The antenna device, according to the aspect of the exemplary embodiments may be formed to extend for a predetermined distance along a length direction of the electronic appliance.

The antenna device according to the aspect of the exemplary embodiments may further include a which connects portion connecting the antenna portion to the reflecting portion.

The connecting portion may connect one end of the antenna portion to one end of the reflecting portion.

The connecting portion may be vertically or perpendicularly oriented with respect to the antenna portion and the reflecting portion.

The antenna portion, the reflecting portion, and the connecting portion may be integrally formed.

The antenna device, according to the aspect of the exemplary embodiments may further include a first connecting portion which connects one end of the antenna portion to one end of the reflecting portion; and a second connecting portion which connects the other end of the antenna portion to the other end of the reflecting portion.

The first connecting portion and the second connecting portion may be vertically or perpendicularly oriented with respect to the antenna portion and the reflecting portion.

The first connecting portion and the second connecting portion may be inclined against both the antenna portion and the reflecting portion.

The antenna portion, the reflecting portion, the first connecting portion, and the second connecting portion may be integrally formed.

The antenna portion may be any one of a slot type, a monopole type, and a planar inverted-F type but is not limited thereto.

The reflecting portion and the connecting portion may be made of metal.

The reflecting portion and the connecting portion may be formed in the shape of a flat plate.

According to another aspect of the exemplary embodiments, an electronic appliance includes the above-described antenna device.

The radio wave passer may be formed of nonmetal.

The radio wave passer may be an opening exposed to an outside of the electronic appliance.

The electronic appliance may be a camera.

As described above, according to the various exemplary embodiments, an antenna device having good radio wave radiation efficiency and the electronic appliance having the same, can be implemented.

BRIEF DESCRIPTION OF THE DRAWINGS

The above and other aspects, features and advantages of the exemplary embodiments will be more apparent from the following detailed description when taken in conjunction with the accompanying drawings, in which.

DETAILED DESCRIPTION OF THE EXEMPLARY EMBODIMENTS

Figure 1:
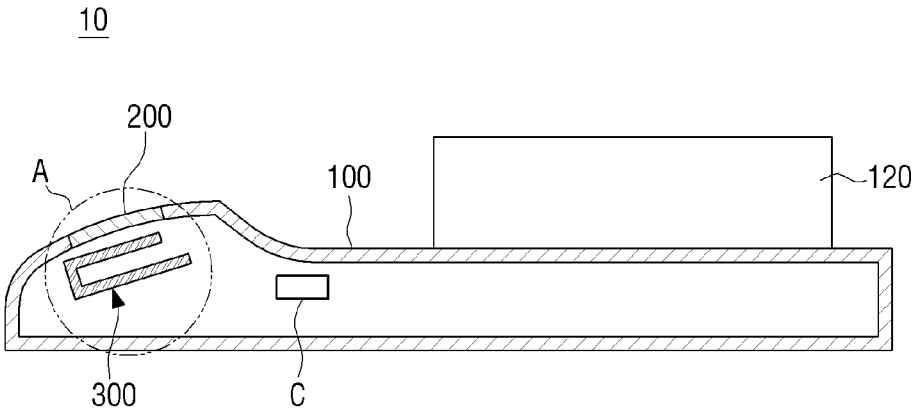
FIG. 1 is a schematic cross-sectional view which illustrates an electronic appliance according to a first exemplary embodiment.

Hereinafter, exemplary embodiments are described in detail with reference to the accompanying drawings. The exemplary embodiments hereinafter disclosed are exemplary in nature and are provided for an understanding of the present disclosure. It should be understood that the present disclosure can be implemented in diverse forms differently from the exemplary embodiments which are hereinafter disclosed. Further, in the drawing, sizes of some constituent elements may be exaggerated for clarity in explanation.

FIG. 1 is a schematic cross-sectional view which illustrates an electronic appliance according to a first exemplary embodiment.

An electronic appliance 10 may be one of various radio-communicable appliances. For example, the electronic appliance 10 may be any one of a camera, a smart phone, a PDA (Personal Digital Assistant), a lap-top computer, a tablet appliance, and other display devices. Hereinafter, in this exemplary embodiment, it is assumed that the electronic appliance is a camera.

Referring to FIG. 1, the electronic appliance 10 includes a metal cover 100, a lens barrel 120, and an antenna device 300.

The metal cover 100 forms an elegant external appearance of the electronic appliance 10 in comparison to a nonmetal cover. Various kinds of components (not illustrated) for driving and controlling the electronic appliance 10 and a wireless communicator C for performing wireless communication with an external device (not illustrated) are accommodated in the metal cover 100. The wireless communicator C may use communication methods, such as Wi-Fi and Bluetooth, and perform communication in accordance with other various wireless communication methods.

On the metal cover 100, a radio wave passer 200 is provided. The radio wave passer passes radio waves for radio wave transmission and reception of the antenna device 300. The radio wave passer 200 is made of a nonmetal material so that the radio waves radiated from the antenna device 300 can pass through the radio wave passer 200. For example, the radio wave passer 200 may be made of plastic.

Further, the radio wave passer 200 may be an opening that is exposed to the outside of the metal cover 100. The lens barrel 120 is mounted on a front portion of the camera, and is provided with a plurality of optical lenses (not illustrated) for guiding and forming an image of an object. The lens barrel 120 performs a zoom operation of adjusting the magnification of the image of the object and a focusing operation of focusing the object while moving the optical lenses (not illustrated) in a direction of an optical axis.

The antenna device 300 is electrically connected to the above-described wireless communication unit C through a wire (not illustrated), or the like, to transmit and receive radio waves so that the wireless communication can be performed between the electronic appliance 10 and an external device. The antenna device 300 radiates the radio waves to the outside of the electronic appliance 10 for radio wave transmission and reception. Further, the antenna device 300 is provided with a built-in antenna portion that is built in the electronic appliance as part of the design of the electronic appliance 10.

The antenna device 300 is arranged adjacent to the radio wave passer 200, and is fitted into a substrate or is fixed in the electronic appliance 10 by a fastening component, or the like. The antenna device 300 may be fixed in the electronic appliance 10 by various methods. Since this is a general matter that would be readily understood by those skilled in the art, the detailed description thereof will be omitted.

Figure 2:
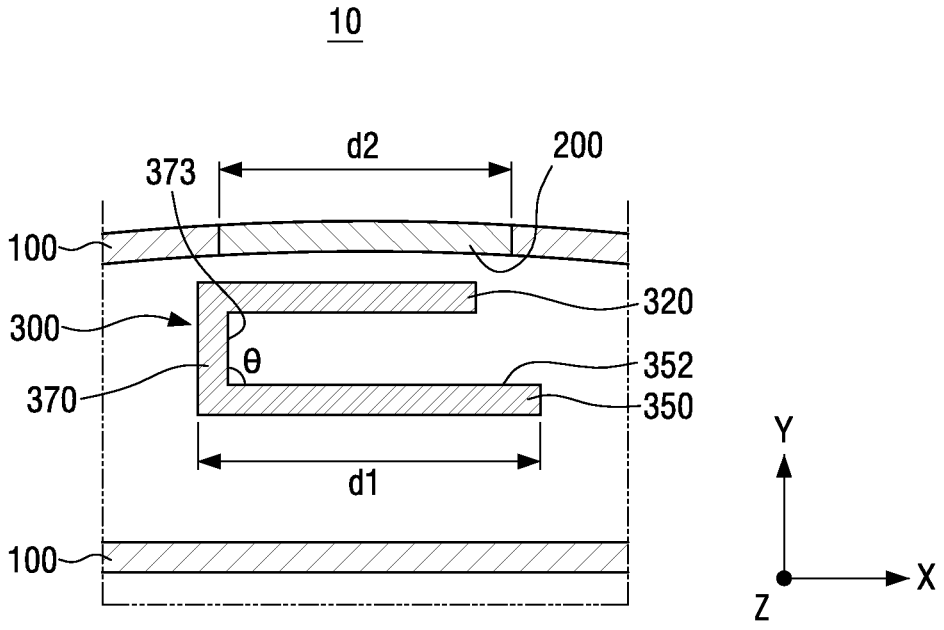
FIG. 2 is a schematic cross-sectional view which illustrates a portion A in FIG. 1.

FIG. 2 is a schematic cross-sectional view illustrating a portion A in FIG. 1.

Referring to FIG. 2, the antenna device 300 includes an antenna portion 320, a reflecting portion 350, and a connecting portion 370.

The antenna portion 320 is connected to the wireless communication module C, and radiates radio waves to the outside of the electronic appliance 10 or receives the radio waves from the outside. For this, the antenna portion 320 is arranged adjacent to the radio wave passer 200 to face the radio wave passer 200. On the other hand, the radio wave passer 200 is formed to extend for a predetermined distance along a length direction (Z direction) of the electronic appliance 10. The antenna portion is formed along a width direction (X direction) of the radio wave passer 200, and extends along a length direction (Z direction) of the radio wave passer 200.

The antenna portion 320 may adopt various types of antenna portion structures. For example, the antenna portion 320 may adopt various types of antenna portion structures, such as a slot type, a monopole type, a dipole type and a planar inverted-F type. That is, the antenna portion may adopt other antenna portion structures which can transmit and receive radio waves, in addition to the above-described antenna portion structures.

The reflecting portion 350 is a metal plate in a flat plate shape, which is provided on an opposite side of the radio wave passer 200 through the antenna portion 320, and is arranged adjacent to the antenna portion 320. The reflecting portion 350 is formed along the width direction (X direction) of the radio wave passer 200 together with the antenna portion 320, and constantly extends along the length direction (Z direction) of the radio wave passer 200.

The width d1 of the reflecting portion 350 is equal to or larger than the width d2 of the radio wave passer 200. In this exemplary embodiment, it is exemplified that the d1 of the reflecting portion 350 is larger than the width d2 of the radio wave passer 200. The reason why the width d1 of the reflecting portion 350 is set to be different from the width d2 of the radio wave passer 200 will be described in detail with reference to FIGS. 4 to 7.

It is preferable that the reflecting portion 350 is arranged in parallel to the radio wave passer 320, and an angle θ between the reflecting portion 350 and the connecting portion 370 is 90 degrees. This is merely exemplary, and the reflecting portion 350 may not be in parallel to the radio wave passer 320. However, in this case, the angle θ between the reflecting portion 350 and the connecting portion 370 should not exceed 180 degrees.

Like the reflecting portion 350, the connecting portion 370 is formed of a metal plate of a flat plate shape. The connecting portion 370 connects between the antenna portion 320 and the reflecting portion 350 through connection of one end of the antenna portion 320 to one end of the reflecting portion 350. In this exemplary embodiment, the antenna portion 320, the reflecting portion 350, and the connecting portion 370 are formed as one member. In other words, the antenna portion 320, the reflecting portion 350, and the connecting portion 370, which form the antenna device 300, are integrally formed.

As a result, in the antenna device 300, the antenna portion 320, the reflecting portion 350, and the connecting portion 370 are formed through bending of a metal member. This is merely exemplary, and it is also possible that the antenna portion 320, the reflecting portion 350, and the connecting portion 370 are connected together as separate members to form the antenna device 300.

On the other hand, an inner surface 352 of the reflecting portion 350 and an inner surface 373 of the connecting portion 370 serve as a ground for the antenna portion 320. Further, the metal cover 100 may additionally serve as ground of the antenna portion 320.

Figure 3:
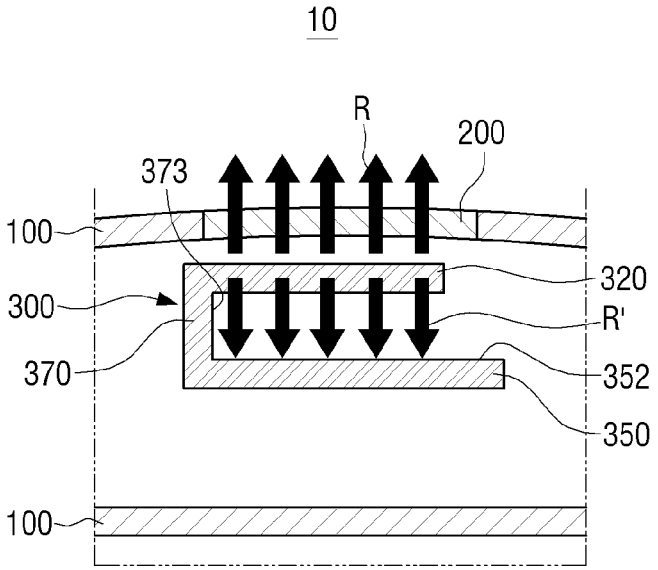
FIG. 3 is a schematic view explaining radio wave radiation of an antenna portion in the antenna device of FIG. 2.

FIG. 3 is a schematic view explaining radio wave radiation of an antenna portion in the antenna device of FIG. 2. Referring to FIG. 3, during radio wave transmission to an outside of the electronic appliance 10, the antenna portion 320, which is arranged in the rear of the radio wave passer 200 in the antenna device 300, radiates radio waves R in a direction toward the radio wave passer 200. The radio waves R radiated in the direction toward the radio wave passer 200 can pass through the radio wave passer 200 and be radiated to the outside of the electronic device 10.

However, the antenna portion 320 radiates radio waves R' in an inside direction of the metal cover 100, that is, in the direction of the reflecting portion 350, in addition to the direction toward the radio wave passer 200. In this state, in response to the reflecting portion 350 not being provided, the radio waves R' are directed in the direction of the metal cover 100 that is arranged in the rear to be shut up in the metal cover 100. Accordingly, the antenna portion 320 of the electronic appliance 10 has low radio wave radiation efficiency.

The reflecting portion 350 serves to guide the radio waves R' again to the antenna portion 320. The detailed operation of the reflecting portion 350 will be described with reference to FIG. 4.

Figure 4:
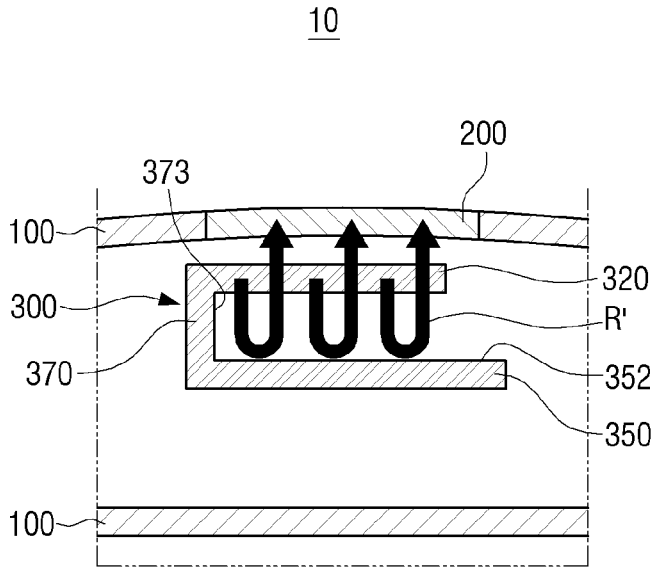
FIG. 4 is a schematic view which illustrates radio wave reflection of a reflecting portion during radio wave transmission of the antenna device of FIG. 2.

FIG. 4 is a schematic view which explains radio wave reflection of the reflecting portion in the antenna device of FIG. 2.

Referring to FIG. 4, the radio waves R' radiated from the antenna portion 320 collide with the inner surface 352 of the reflecting portion 350. At this time, the radio waves R' are reflected in the direction of the antenna portion 320 by the reflecting portion 350. The radio waves R' are input again to the antenna portion 320, and the radio waves R' input to the antenna portion 320 are radiated again to the outside of the electronic appliance 10 through the radio wave passer 200.

Accordingly, the electronic appliance 10 according to this exemplary embodiment can again radiate the radio waves R' input to the inside of the metal cover 100 to the outside of the electronic appliance through the reflecting portion 350 of the antenna device 300. Accordingly, the electronic appliance 10 can effectively radiate the radio waves input to the inside of the metal cover 100 to the outside of the electronic appliance 10, and thus the radiation efficiency of the antenna device 300 in the electronic appliance 10 can be increased.

As described above, the width of the reflecting portion 350 is set to be equal to or larger than the width of the radio wave passer 200. Accordingly, the reflecting portion 350 can secure a reflection possible area at least as large as the width of the radio wave passer 200, and thus the area that can reflect the radio waves R' can be maximally secured.

Although the radio wave transmission of the electronic appliance 10 has been described, the radio wave radiation of the antenna device 300 is performed in a similar manner even during the radio wave reception. Specifically, during the radio wave reception in the electronic appliance 10, the antenna device 300 performs radio wave radiation so that the radio wave signal from the outside of the electronic appliance 10 can be input to the inside of the electronic appliance 10, and in this case, the radio waves input to the inside of the metal cover 10 through the reflecting portion 350 can be effectively reflected in the direction of the antenna portion 320.

Figure 5:
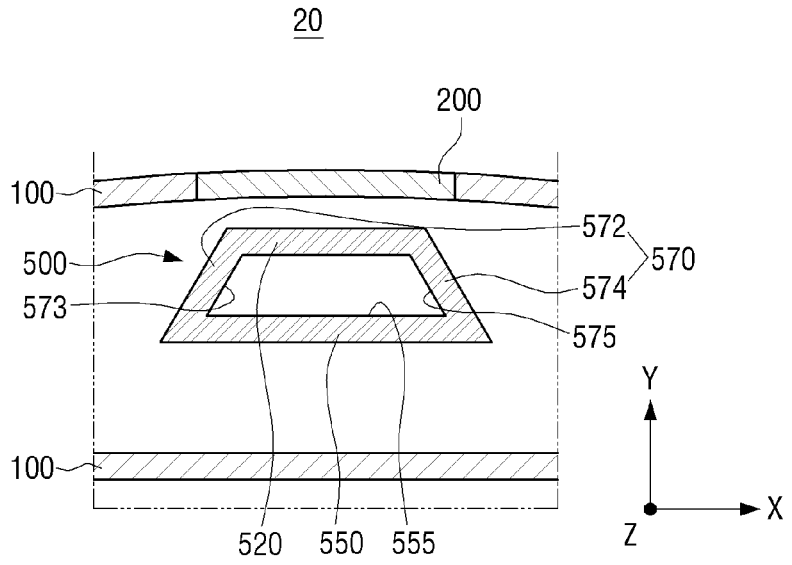
FIG. 5 is a schematic cross-sectional view which illustrates a part of an electronic appliance according to a second exemplary embodiment.

FIG. 5 is a schematic cross-sectional view illustrating a part of an electronic appliance according to a second exemplary embodiment.

Hereinafter, a explanation will be provided that relates to the differences from the first exemplary embodiment. The same reference numerals are used for the same constituent elements as the first exemplary embodiment, and the explanation thereof will be omitted.

Referring to FIG. 5, an electronic appliance 20 includes a metal cover 100, a radio wave passer 200, and an antenna device 500.

The antenna device 500 includes an antenna portion 520, a reflecting portion 550, and a connecting portion 570.

The connecting portion 570 includes a first connecting portion 572 and a second connecting portion 574.

The first connecting portion 572 connects one end of the antenna portion 520 to one end of reflecting portion 550. The second connecting portion 574 connects the other end of the antenna portion 520 to the other end of the reflecting portion 550. The first connecting portion 572 and the second connecting portion 574 are formed to be inclined to an outer direction with respect to the antenna portion 520. That is, in general, the antenna portion 520 is formed with a width that is narrower than the width of the radio wave passer 200, and this is because the reflecting portion 550 is formed with a width that is wider than the width of the radio wave passer 200, as in the first exemplary embodiment.

Accordingly, the antenna device 500 has a trapezoidal cross-section. As a result, it is also possible that the antenna device 500 is formed as a structure that is connected to the reflecting portion 550 through the connecting portion 570 at both ends of the antenna portion 520.

On the other hand, an inner surface 573 of the first connecting portion 572 and an inner surface 575 of the second connecting portion 574 become ground surfaces that serve as ground in the antenna device 500. Further, an inner surface 555 of the reflecting portion 550 also becomes a ground surface that serves as the ground in the antenna device 500 as in the first exemplary embodiment.

Figure 6:
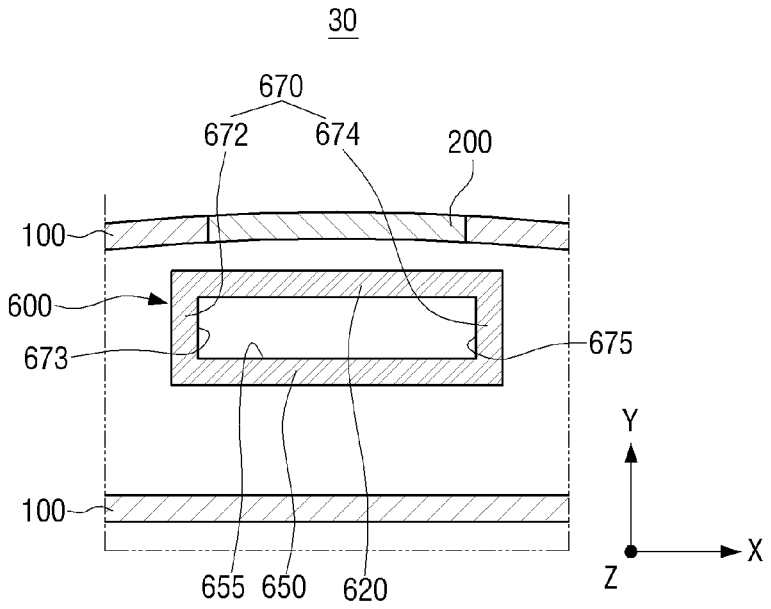
FIG. 6 is a schematic cross-sectional view which illustrates a part of an electronic appliance according to a third exemplary embodiment.

FIG. 6 is a schematic cross-sectional view illustrating a part of an electronic appliance according to a third exemplary embodiment.

Hereinafter, an explanation will be provided which relates to the differences from the first exemplary embodiment. The same reference numerals are used for the same constituent elements as the first exemplary embodiment, and the explanation thereof will be omitted.

Referring to FIG. 6, an electronic appliance 30 includes a metal cover 100, a radio wave passer 200, and an antenna 600.

The antenna 600 includes an antenna portion 620, a reflecting portion 650, and a connecting portion 670.

The connecting portion 670 includes a first connecting portion 672 and a second connecting portion 674.

The first connecting portion 672 connects one end of the antenna portion 620 to one end of reflecting portion 650. The second connecting portion 674 connects the other end of the antenna portion 620 to the other end of the reflecting portion 650. The first connecting portion 672 and the second connecting portion 674 are vertically or perpendicularly formed with respect to the antenna portion 620 and the reflecting portion 650. This is because the antenna portion 620 has the same width as the width of the reflecting portion 650. That is, like the reflecting portion 650, it is also possible that the antenna portion 620 has the width that is equal to or larger than the width of the radio wave passer 200.

In this exemplary embodiment, it is exemplified that like the reflecting portion 650, the antenna portion 620 has the width which is larger than the width of the radio wave passer 200 and is equal to the width of the reflecting portion 650. As a result, the antenna device 600 has a rectangular cross-section.

However, the exemplary embodiments are not limited thereto. It is also possible that the antenna portion has a larger width than the reflecting portion in the antenna device. In this case, the respective connecting portions are formed to be inclined toward the inside. That is, unlike the second and third exemplary embodiments, the antenna device may be formed to have a reversed trapezoidal cross-section.

Figure 7:
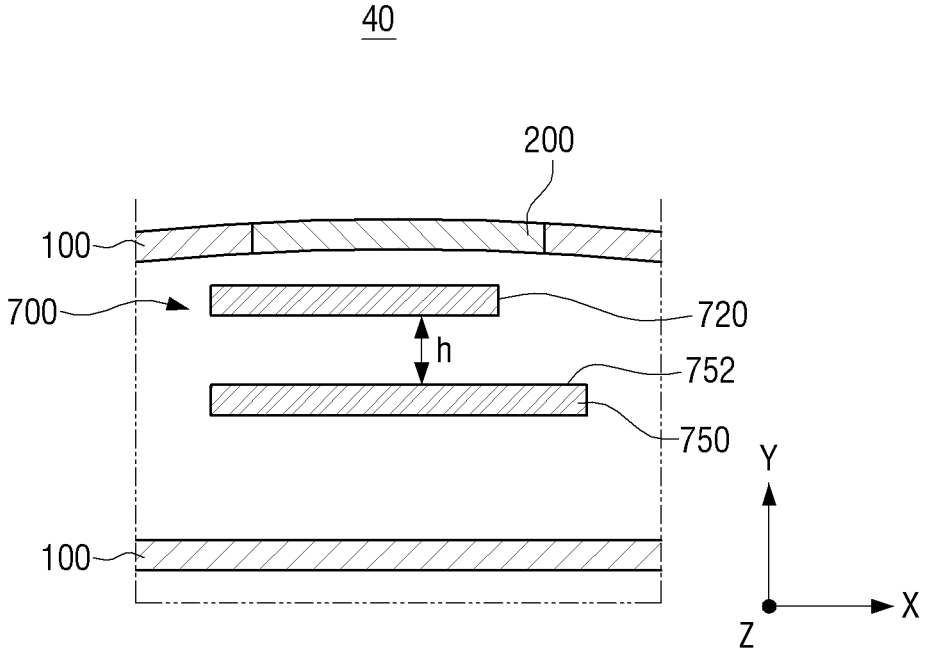
FIG. 7 is a schematic cross-sectional view which illustrates a part of an electronic appliance according to a fourth exemplary embodiment.

FIG. 7 is a schematic cross-sectional view illustrating a part of an electronic appliance according to a fourth exemplary embodiment of the present disclosure.

Hereinafter, an explanation will be provided that relates to the differences from the first exemplary embodiment. The same reference numerals are used for the same constituent elements as the first exemplary embodiment, and the explanation thereof will be omitted.

Referring to FIG. 7, an electronic appliance 40 includes a metal cover 100, a radio wave passer 200, and an antenna device 700.

The antenna device 700 includes an antenna portion 720 and a reflecting portion 750.

In this embodiment, the antenna portion 720 and the reflecting portion 750 are provided as separate members. The antenna portion 720 and the reflecting portion 750 are fixed in the metal cover 100 through the above-described general fastening structure or fastening member in the electronic appliance 40. The antenna portion 720 has the same antenna portion structure as the antenna portion in the related art, and may adopt various types of antenna portion structures as described above. The reflecting portion 750 is arranged in the rear of the antenna portion 720 to be spaced apart for a predetermined distance h from the antenna portion 720.

The reflecting portion 750 is made of a metal plate having a flat plate shape with a width that is equal to or larger than the width of the radio wave passer 200 as in the first exemplary embodiment. In this exemplary embodiment, it is exemplified that the reflecting portion 750 has a larger width than the radio wave passer 200.

In this exemplary embodiment, since the reflecting portion 750 is arranged in the rear of the antenna portion 720 to be spaced apart for a predetermined distance from the antenna portion 720, the radio wave input to the rear of the antenna portion 720 can be reflected to the antenna portion 720 through the inner surface 752 of the reflecting portion 750 as in the first exemplary embodiment.

As a result, in response to the reflecting portion 750 being arranged on an opposite side of the antenna portion from the radio wave passer 200, it is also possible that the reflecting portion 750 is provided as a separate member from the antenna portion 720 as in this exemplary embodiment.

While the present disclosure has been shown and described with reference to certain exemplary embodiments thereof, it will be understood by those skilled in the art that various changes in form and detail may be made therein without departing from the spirit and scope of the present disclosure, as defined by the appended claims.

What is claimed is:

1. An antenna device built into an electronic appliance having a metal cover which is provided with a radio wave passage, the antenna device comprising:

an antenna portion arranged adjacent to the radio wave passage so as to be capable of transmitting and receiving radio waves through the radio wave passage;

a reflecting portion which reflects the radio waves radiated from the antenna portion to an opposite side of the radio wave passage toward the radio wave passage;

a connecting portion which connects the antenna portion to the reflecting portion;

a first connecting portion which connects one end of the antenna portion to one end of the reflecting portion; and a second connecting portion which connects the other end of the antenna portion to the other end of the reflecting portion and is positioned to face the first connecting portion, wherein the antenna portion, the reflecting portion and the connecting portion are formed of a metal member, and wherein the metal member is bent so that the antenna portion and the reflecting portion face each other.

2. The antenna device as claimed in claim 1, wherein a width of the reflecting portion is at least equal to a width of the radio wave passage.

3. The antenna device as claimed in claim 1, wherein the reflecting portion is arranged parallel to the radio wave passage.

4. The antenna device as claimed in claim 1, wherein the antenna device is configured to extend for a predetermined distance along a length direction of the electronic appliance.

5. The antenna device as claimed in claim 1, wherein the connecting portion is perpendicularly oriented between the antenna portion and the reflecting portion.

6. The antenna device as claimed in claim 1, wherein the first connecting portion and the second connecting portion extend perpendicularly with respect to the antenna portion and the reflecting portion.

7. The antenna device as claimed in claim 1, wherein the first connecting portion and the second connecting portion are inclined with respect to the antenna portion and the reflecting portion.

8. The antenna device as claimed in claim 1, wherein the antenna portion is any one of a slot type, a monopole type and a planar inverted-F type antenna.

9. The antenna device as claimed in claim 1, wherein the reflecting portion and the connecting portion are in the shape of a flat plate.

10. An electronic appliance comprising a metal cover which is provided with a radio wave passage and an antenna device which is disposed in the metal cover, wherein the antenna device comprises:

an antenna portion arranged between the radio wave passage and a reflecting portion so as to be capable of transmitting and receiving radio waves through the radio wave passage;

a reflecting portion which reflects the radio waves radiated from the antenna portion to an opposite side of the radio wave passage toward the radio wave passage;

a connecting portion which connects the antenna portion to the reflecting portion;

a first connecting portion which connects one end of the antenna portion to one end of the reflecting portion; and a second connecting portion which connects the other end of the antenna portion to the other end of the reflecting portion and is positioned to face the first connecting portion, wherein the antenna portion, the reflecting portion and the connecting portion are formed of a metal member, and wherein the metal member is bent so that the antenna portion and the reflecting portion face each other.

11. The electronic appliance as claimed in claim 10, wherein the radio wave passage is formed of nonmetal material.

12. The electronic appliance as claimed in claim 10, wherein the radio wave passage is an opening exposed to an outside of the electronic appliance.

13. The electronic appliance as claimed in claim 10, wherein the electronic appliance is a camera.

* * * * *